United States Patent [19]

Hrenyo

[11] 4,375,262

[45] Mar. 1, 1983

[54] CONTAINERS FOR FRAGILE ARTICLES

[75] Inventor: John Hrenyo, Towaco, N.J.

[73] Assignee: Tekni-Plex, Inc., Brooklyn, N.Y.

[21] Appl. No.: 291,775

[22] Filed: Aug. 10, 1981

Related U.S. Application Data

[63] Continuation of Ser. No. 22,637, Mar. 21, 1979, abandoned.

[51] Int. Cl.[3] ..... B65D 85/16; B65D 85/42

[52] U.S. Cl. ..... 206/418; 206/521; 206/523; 206/592; 229/2.5 R; 229/39 B; 220/4 E

[58] Field of Search ..... 206/418, 419, 420, 422, 206/461, 462, 463, 521, 523, 583, 585, 590, 591, 592; 220/4 B, 4 E; 229/2.5 R, 39 B; 217/21

[56] References Cited

U.S. PATENT DOCUMENTS

| | | | |
|---|---|---|---|
| 2,014,091 | 9/1935 | Shepard | 217/21 |
| 2,428,384 | 10/1947 | Randall | 206/422 |
| 2,774,473 | 12/1956 | Williams | 206/422 |
| 3,127,993 | 4/1964 | Phipps | 206/462 |
| 3,146,929 | 9/1964 | Keim | 206/523 |
| 3,241,661 | 3/1966 | Zamzow et al. | 206/523 |
| 3,534,128 | 10/1970 | Makowski | 229/2.5 EC |
| 4,114,759 | 9/1978 | Maloney | 206/523 |

FOREIGN PATENT DOCUMENTS

| | | | |
|---|---|---|---|
| 153747 | 10/1953 | Australia | 206/418 |
| 861668 | 1/1953 | Austria | 206/419 |
| 69048 | 4/1949 | Denmark | 206/418 |
| 320475 | 10/1929 | United Kingdom | 206/418 |

*Primary Examiner*—William T. Dixson, Jr.
*Attorney, Agent, or Firm*—Daniel J. Reardon

[57] ABSTRACT

This invention relates to an improved package or container made of a rigid cellular foam for protecting fragile articles such as light bulbs during storage or transport and is composed of two hingedly connected housing elements having recesses adapted to enclose said article; holding it in snug engagement within the container and having outer surfaces sloped at each end and polygonal shaped intermediate portions forming ribs providing protection to the contained article in a radial direction, with coplanar flanges extending outwardly from the foregoing recesses in a plane substantially perpendicular to the cross-sectional plane defined by said polygonal ribs.

14 Claims, 6 Drawing Figures

Fig.1.
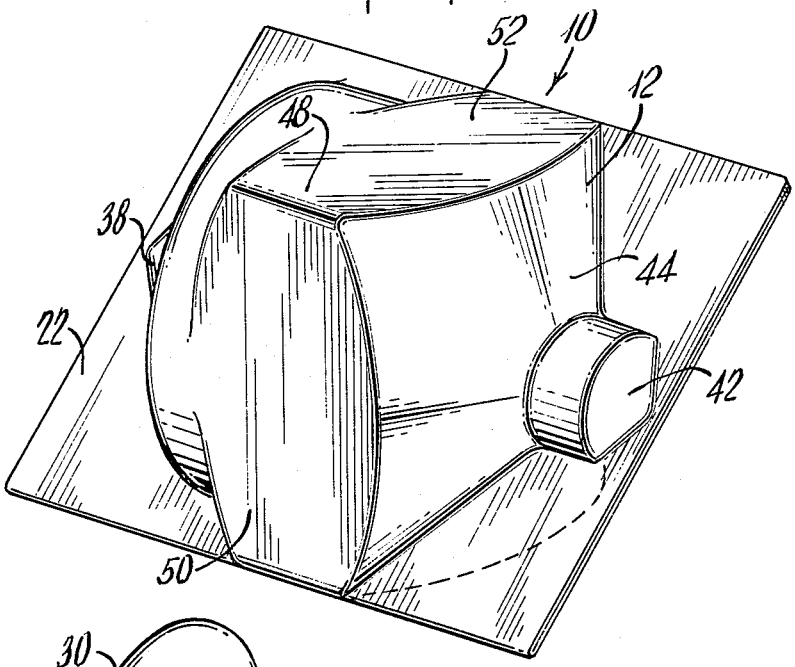
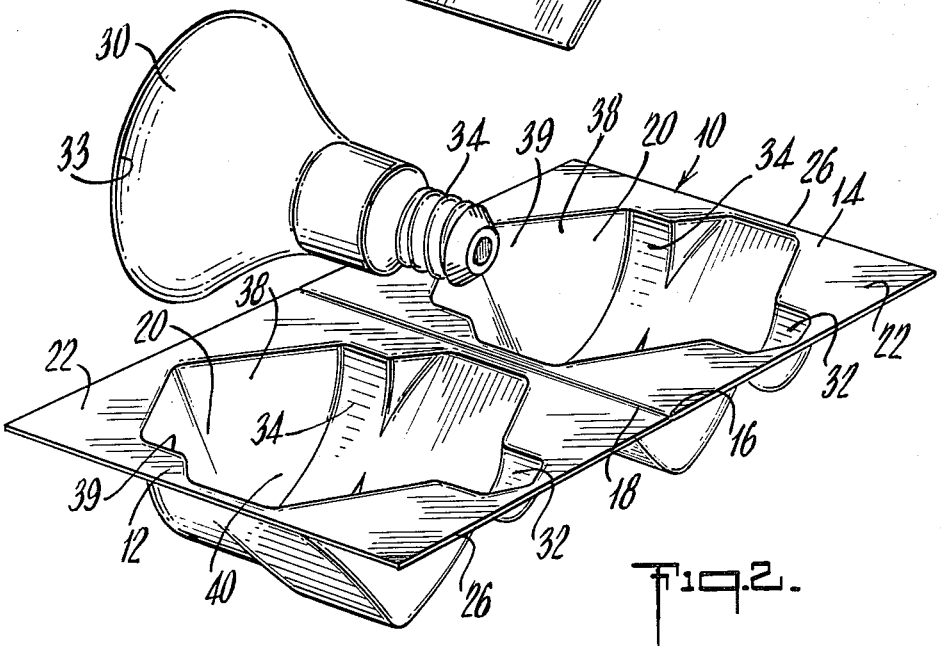
Fig.2.

CONTAINERS FOR FRAGILE ARTICLES

This is a continuation of application Ser. No. 22,637 filed Mar. 21, 1979, now abandoned.

BACKGROUND OF THE INVENTION

The present invention relates to protective containers for fragile articles such as glass light bulbs or the like.

Such fragile articles are, of course, easily damaged in transport and even during storage. Typically, such articles are packaged in containers having corrugated paperboard inserts to cushion the articles from shock. It is often difficult and time consuming to place these corrugated inserts completely around the article and, to save packaging costs, surface portions of irregularly shaped articles are often left unprotected. Further, many of the packages of the prior art merely function to cushion a localized shock applied to the package, and do not distribute the force of the shock throughout the package and thus reduce any shock transmitted to the article itself.

It is, therefore, an object of the present invention to provide a container which fully encases a fragile article to protect its entire surface from shock.

It is a further object of the present invention to provide such a container wherein localized shocks applied thereto are distributed and dissipated throughout the container.

An additional object of the present invention is to provide a container wherein the fragile article can be placed quickly and simply, and the package itself manufactured simply, and inexpensively, as well.

A still further object of the invention is to provide a container in which construction and the material employed therein are mutually reinforcing in providing a light, strong, shock-resistant receptacle.

The foregoing as well as other objects, features and advantages of the present invention will become apparent from the following detailed description and accompanying drawing of an illustrative embodiment of the present invention.

BRIEF DESCRIPTION OF THE DRAWING

FIG. 1 is a perspective view of a container in accordance with the invention in a closed state.

FIG. 2 is a perspective view of the opened interior of the container of FIG. 1, with an article suitable for containment therein.

DESCRIPTION OF THE PREFERRED EMBODIMENT

Figure 5:
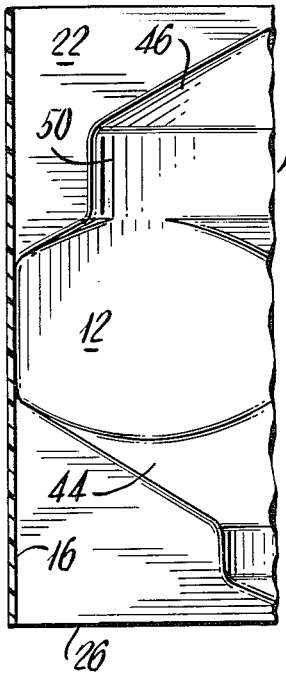
FIG. 5 is a fragmentary perspective view of that portion of the container taken along the lines 5—5 of FIG. 3.

The present invention is thus illustrated by the following description taken in conjunction with the drawing, wherein there is shown a container 10 formed of a rigid cellular foam as defined hereinafter and composed of a first housing element 12 and a second housing element 14 interconnected by a hinge 16 formed along and continuous with the apposed edges 18 of the foregoing elements 12 and 14. The hinge 16 is shown in the drawing extending the length of the complementary edges 18. This embodiment provides enhanced strength to the hinge but as will be evident, the hinge may encompass only a portion, but preferably a central portion, of adjacent edges 18.

Figure 6:
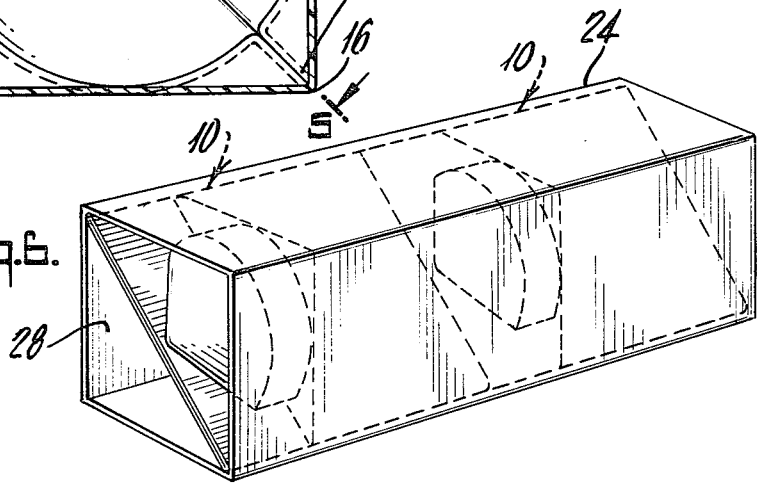
FIG. 6 is a perspective view of a plurality of containers of the invention in a packaged assembly.

The housing elements 12 and 14 may be the same or different, but in a significantly preferred embodiment, are identical in mirror image as shown in the drawing. The housing elements 12 and 14 each include a recessed portion 20 shown, for example, in FIG. 2, surrounded by a flange 22, one edge 18 of which is, as described hereinabove, continuous in each instance in a preferred embodiment with the hinge 16. The flanges may be polygonal but are preferably rectangular as shown in the drawing. They need not be identical in conformation; but, again, are preferably so, to fulfill that objective of the invention wherein a plurality of the containers containing, illustratively, light bulbs, flash attachments, or the like, are snugly mounted in an outer sleeve 24 as shown in FIG. 6 but are isolated from the inner periphery or wall 28 thereof by the flange 22. It will be evident in this context that the contour of the flange edges 26, having free lateral margins, and those (18) with which the hinge is continuous, may assume various shapes so long as they are polygonal and conform along a significant portion of their length to the shape of the inner wall 28 of the sleeve and the complementary edge of the neighboring containers and thus are prevent from rotation in the sleeve 24 or movement along the sleeve 24 when fully assembled.

Figure 4:
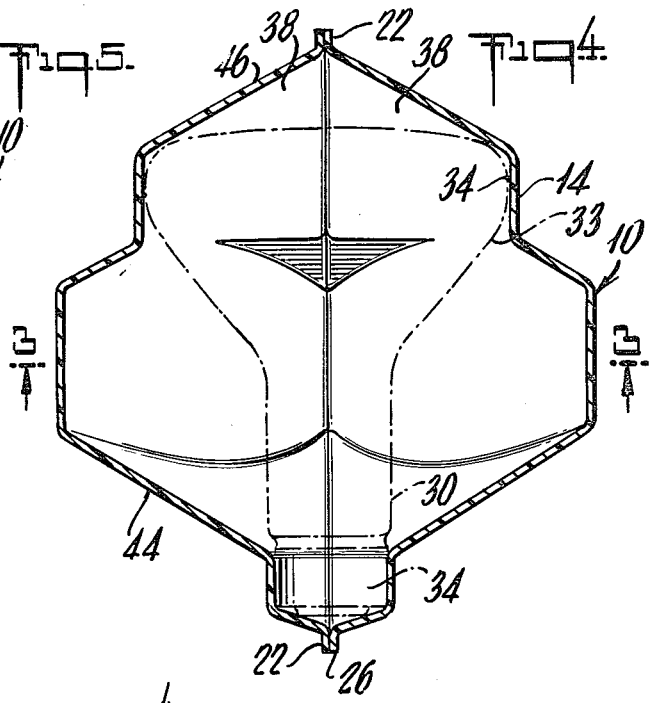
FIG. 4 is a vertical section taken along the lines 4—4 of FIG. 3.
Figure 3:
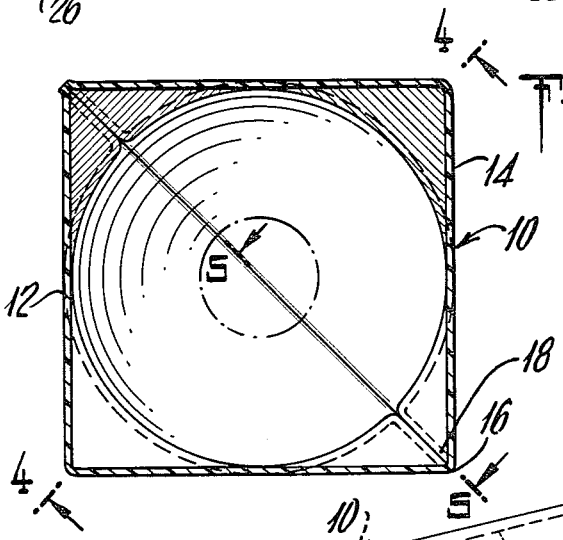
FIG. 3 is a horizontal cross-sectional view taken along the lines 3—3 of FIG. 4.

The hinge 16 may be formed of an adhesive strip made to adhere to the continuous edges 18 of the flange 22 but in a particularly desirable embodiment critical to attainment of economical production and maximum effectiveness as a protective device over an extended period using the rigid cellular foams as characterized hereinafter, the container is of unitary construction and formed, of course, in a single mold. The hinge is compressed along its length and may be folded along its compressed length. The recessed portions 20 of the housing elements 12 and 14, as indicated above, are centrally disposed therein to isolate the contained fragile article 30 (shown in FIG. 3 and by the broken lines in FIG. 4) and facilitate protection thereof.

As shown in the preferred embodiment of the drawing, the recesses 20 are particularly adapted to receive in snug, but limited engagement, a light bulb 30 or article of similar shape. The recessed portions 20 are thus formed in a predetermined shape in which the bulb stem-receiving ends or poles 32 of the recesses are arcuately shaped, and in a preferred embodiment for general application, are semi-cylindrical in conformation and complement one another to provide a cylindrical enclosure or neck receiving the bulb stem 34 in snug engagement. The expanded distal or opposite end 33 of the bulb remote from the stem is engaged about its lateral margins by the complementary semi-cylindrical segments 34 in the container's closed state. These latter segments 34 engage in a complementary manner the entire outer surface of the bulb 30 at its point of greatest lateral extension and are adjacent to, and continuous with, the opposite ends 38 of the housing elements 12 and 14 and are formed in an axially sloped, contracting, and flat (as shown in the drawing) or arcuate manner about, but removed from contact with, the otherwise vulnerable expanded glass bulb portion of the light bulb 30 when the container or package is closed, to provide an axially extended dead-air space 39 in the closed container as a resource against compressive shock and a structural reinforcement for the cylindrical portion of the container 10 formed by the semi-cylindrical segments 34.

Intermediate between the semi-cylindrical segments 38 and the stem-receiving end 32 the recessed portions 20 are expanded to provide a radially distended air space 40 about the bulb affording protection for the bulb against compressive force and shock along the length of the bulb 30. The area of contact between bulb and package is thus limited to that necessary to secure engagement within the package or container 10.

The conformation of the recesses 20 integrate with and complement, in a preferred embodiment, the shape of the exterior surfaces of the container 10. Thus, the outer surface of each housing part 12 and 14 has a protuberance 42 complementing the bulb stem end portion 32 forming the neck of the recess 20. This protuberance 42 is continuous with an expanded, sloped and flat or convex arcuate section 44 providing additional strength axially to the intermediate construction of the container 10. The foregoing section 44 is matched at its opposite end by the exterior surface or wall 46 similarly sloped, arcuate and, flat or convex, as it expands in the axial direction. The section 44 merges about its lateral margins into the flange 22 and is, as shown illustratively in the drawing, coextensive with and defines the expanded ends 38 of the recesses 20. The expanded portions 44 and 46 terminate, respectively, at their intermediate borders in a polygonal rib structure 48 and an arcuate, and in the preferred embodiment of the drawing, a semi-cylindrical, segment 50 disposed parallel to and adjacent the foregoing rib structure 48. This latter segment 50 defines and complements interiorly the semi-cylindrical bulb engaging segment 34 of the recess 20. The arcuate or semi-cylindrical segment 50 of the housing element 12 is complementary with that of the housing element 14 providing a cylindrical segment.

The adjacent rib and cylinder structures reinforce each other providing shock and impact resistance radially with respect to the contained fragile article 30. The rib structure 48 composed of ribs 52 is polygonal and preferably semi-rectangular, the complementary rib constructions of the two housing elements forming a rectangular construction of unique strength, impact and shock-resistance; particularly in context, with the arcuate axially convex segments 44 and 46, complementing the semi-cylindrical segments 50 and the distended dead air space 40 underlying the foregoing.

The ribs 52 and flange 22 are disposed at right angles to each other in the embodiment shown in the drawing; and indeed no substantial variation therefrom is permitted consistent with the practice of the present invention. Thus, the two coplanar flanges 22 extend outwardly from the recessed portions 20 of the housing elements 12 and 14 when closed in a plane substantially perpendicular to the cross-sectional plane defined by said polygonal, and preferably square, rib construction of both housing element members 12 and 14.

The ribs 52 and flange 22 prevent free rotation of the bulb container 10 when placed on a table or other suitable surface. At the same time, the rib structure 48, particularly where it is a square or rectangular configuration, provides abutting surfaces for secure and stable support or positioning in any given position and for snug contact with the inner sleeve wall 28 when mounted in a tube or sleeve as shown illustratively in FIG. 6 or indeed, for contact with the ribs of an adjacent container when the containers' flanges 22 are disposed transversely within the sleeve in an alternative arrangement. As shown in FIG. 6 the flanges of the adjacent containers 10 and **10*a*** are aligned in the same plane. The containers may however be so positioned that the planes defined by the flanges of alternate or succeeding containers are perpendicular to one another.

It is imperative in accordance with the invention that the container 10 be formed of a molded rigid cellular foam having a density of at least about 1.8 pounds per cubic foot (pcf), and more desirably at least 2 or 3 pcf.

The term "cellular foam" or "cellular plastic" as employed herein is intended to embrace a plastic, the apparent density of which is decreased substantially by the presence of numerous cells disposed throughout its mass. More particularly, these terms are meant to define those two phase gas-solid systems in which the solid is a synthetic plastic or rubber and the solid phase is continuous. The gas phase is usually present in the cells formed in the plastic composition. A "rigid plastic" as this term is employed herein and as it is defined by the American Society for Testing and Materials is one that has a stiffness or apparent modulus of elasticity, "E", greater than 7,000 kg/cm$^2$ (100,000 psi) at 23° C. A "rigid cellular foam", "rigid cellular plastic foam" or words of similar import, where employed herein, are those cellular foams in which the resin or plastic solid phase is a rigid plastic.

Illustrative of the rigid cellular foams employed in the fabrication of the container for use herein, and indeed preferred, is molded polystyrene, having a density of from 2 pcf, and preferably 4 pcf to 12 pcf. Other illustrative rigid cellular foams for use herein include foamed-in-place polyether urethane, poly (phenol formaldehyde) epoxy resin foams, polyethylene, polyvinyl chloride, silicone, cellulose acetate, urea formaldehyde and the vulcanized product, ebonite, all with densities within the range of about 1.8 lb./cu.ft. to 12 lb./cu.ft. and preferably 2.0 to 4 lb./cu.ft. The rigid foams may be open or closed celled. Further elaboration on the resins for use herein appears in Kirk-Othmer, *Encyclopedia of Chemical Technology,* 2nd edition, Vol. 9, pages 847–881, 1966 (John Wiley & Sons, Inc.) and is incorporated by reference in the present disclosure.

The foregoing rigid cellular foams are well known and are intended to include, particularly those of the foregoing polymers, whether alone or suitably modified by methods well known to those skilled in the art, with other compositions including conventional polymer additives, copolymers, mixtures and the like; for example, rubber modified polystyrene. Of particular significance for use herein are those of the foregoing polymers suitably modified to have a high impact resistance, that is an Izod impact strength (determined by ASTM D 256) of 0.25 to 15.0 ft. lb./in. and most desirably rigid polystyrene foam having an Izod impact strength of from 0.30 to 3.0 ft. lb./in. The further disclosure and characterization of these impact modified polymers appearing in the *Encyclopedia of Polymer Science and Technology,* Vol. 7 pages 607–620, 1967 (John Wiley & Sons, Inc.) is also incorporated herein by reference.

It will be evident that the resin used is significant in relation to the structure of the container described herein. On the other hand, while described in the embodiment of the drawing as complementary it will be obvious that the outer surfaces and interior recesses need not be wholly complementary in that, by way of illustration, the inner surface may be entirely cylindrical or angular with flat interior walls or incorporate combinations of these modes of construction depending on the article to be retained in a supported relationship in the package or container 10.

It will be evident, too, that the terms and expressions employed herein are intended as terms of description and not of limitation. Similarly, while the present invention has been described and illustrated with reference to a particular embodiment, it will be apparent that the novel features of the invention may also be employed in other forms while still incorporating the invention that is defined by the appended claims.

What is claimed is:

1. A protective container for a fragile article comprising two hingedly connected housing elements; said housing elements providing, when in registry with each other, a closed container for said article; a major portion of the interior of said housing elements, when in registry, being disposed in spaced, radially expanded, recessed relation to said article; the interior of said housing elements having complementary arcuate segments to provide a surface for engaging the lateral margin of said contained article along a portion of its length; a segment of each of said major portions of said housing elements radially expanded and recessed from said contained article being modified to form in registry polygonally disposed ribs to provide an at least stability for said container and support of said container and article against compressive forces exerted radially on the exterior of said container; said radially expanded and recessed portions of said housing elements having, in addition, opposed exterior ends, defined by sloped, radially contracting surfaces terminating in coplanar flange components, extending outwardly and disposed substantially perpendicularly to the cross-sectional plane defined by said ribs; said ribs being positioned about midway between the opposite ends of said flange components; said hinged connection of said housing elements being provided along adjacent edges of said flange components; and said container being further adapted for retention within a sleeve polygonally shaped in cross-section and in such manner that the flange components of said container intersect diagonally opposed corners of said sleeve.

2. A protective container as claimed in claim 1 wherein the arrangement is such that the substantially flat surfaces defined by said ribs cooperate with said flange components to support said container in any given position; and said housing elements are formed or rigid cellular foam having a density of at least 1.8 pounds per cubic foot.

3. A protective container for fragile articles as claimed in claim 1 wherein said container is of unitary construction; said hinged interconnection between said housing elements being continuous therewith.

4. A protective container for fragile articles as claimed in claim 1 wherein said container is formed of cellular foam having a density of from about 3 pounds per cubic foot to 12 pounds per cubic foot.

5. A protective container for fragile articles as claimed in claim 1, 2 or 3 wherein said container is formed of cellular polystyrene foam.

6. A protective container for fragile articles as claimed in claim 4 wherein said density is within the range of 4 pounds per cubic foot to 12 pounds per cubic foot.

7. A protective container for fragile articles as claimed in claim 1 wherein the polygonal ribs of said housing elements form a rectangle when the container is in the closed state.

8. A protective container for fragile articles as claimed in claim 7 wherein said container is adapted for removal from said sleeve.

9. A combination of two or more containers as defined in claim 1 wherein the containers are supported on complementary flat surfaces defined by said ribs in a columnar direction within an outer sleeve.

10. A combination of at least two of said containers as claimed in claim 1 wherein said containers are supported in a columnar alignment in said sleeve by the complementary flat surfaces defined by said ribs and said coplanar flanges disposed perpendicularly to said ribs in engagement with the inner walls of said sleeve, the cross-sectional configuration of which is similar to that defined by said ribs of said container in the closed state.

11. A protective container as claimed in claim 1 wherein the polygonal ribs of said housing elements, when in register, define a square.

12. A protective container as claimed in claim 11 wherein said flange components define a square.

13. A protective container as claimed in claim 12 wherein said sleeve defines a square in horizontal cross-section.

14. A protective container for a fragile article such as a light bulb or the like, comprising two substantially similar housing elements formed from rigid cellular foam having a density of about 1.8 pound per cubic foot to about 12 pounds per cubic foot and an apparent modulus of elasticity in excess of 7000 kg/cm$^2$ at 23° C. and interconnected hingedly along adjacent edge portions thereof, said housing elements each including a central recessed portion formed in a predetermined shape to conform substantially to the exterior of said container and to envelope an article of a particular shape therebetween and coplanar flange portions extending outwardly from said recessed portion, said recessed portions including respective lower portions shaped to hold a base portion of said article therebetween and respective intermediate portions each extending between the lower portion and upper portion of respective recessed portions and shaped to be spaced from said article.

* * * * *